US011326444B2

(12) United States Patent
Romer et al.

(10) Patent No.: US 11,326,444 B2
(45) Date of Patent: May 10, 2022

(54) HYDROCARBON WELLS AND ASSOCIATED METHODS THAT UTILIZE RADIO FREQUENCY IDENTIFICATION TAGS AND FLOWABLE INTERROGATORS TO INTERROGATE THE HYDROCARBON WELLS

(71) Applicant: ExxonMobil Upstream Research Company, Spring, TX (US)

(72) Inventors: Michael C. Romer, The Woodlands, TX (US); Rami Jabari, The Woodlands, TX (US); P. Matthew Spiecker, Manvel, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 114 days.

(21) Appl. No.: 17/064,030

(22) Filed: Oct. 6, 2020

(65) Prior Publication Data

US 2021/0131275 A1 May 6, 2021

Related U.S. Application Data

(60) Provisional application No. 62/929,149, filed on Nov. 1, 2019.

(51) Int. Cl.
*E21B 47/13* (2012.01)

(52) U.S. Cl.
CPC ..... *E21B 47/13* (2020.05)

(58) Field of Classification Search
CPC ..... E21B 47/095; E21B 47/13; E21B 47/138
See application file for complete search history.

(56) References Cited

U.S. PATENT DOCUMENTS

2013/0278433 A1* 10/2013 Baxter ..... G06K 7/0008 340/854.4
2016/0003769 A1* 1/2016 Roundhill ..... G01N 22/00 436/120
2018/0136356 A1* 5/2018 Wilson ..... E21B 47/113
2018/0356512 A1* 12/2018 Alkhabbaz ..... G01S 13/74

* cited by examiner

*Primary Examiner* — Omer S Khan
(74) *Attorney, Agent, or Firm* — Leandro Arechederra, III

(57) ABSTRACT

Hydrocarbon wells and associated methods that utilize radio frequency identification (RFID) tags and flowable interrogators to interrogate the hydrocarbon wells are provided. The hydrocarbon wells include a wellbore, a downhole tubular that defines a tubular conduit and extends within the wellbore, and a plurality of RFID tags. The hydrocarbon wells also include a downhole interrogator storage structure that includes a plurality of flowable interrogators and a well-side communication device. Methods of operating the hydrocarbon wells are also provided.

13 Claims, 4 Drawing Sheets

HYDROCARBON WELLS AND ASSOCIATED METHODS THAT UTILIZE RADIO FREQUENCY IDENTIFICATION TAGS AND FLOWABLE INTERROGATORS TO INTERROGATE THE HYDROCARBON WELLS

CROSS-REFERENCE TO RELATED APPLICATION

This application claims the benefit of U.S. Provisional Application 62/929,149, filed Nov. 1, 2019, the disclosure of which is hereby incorporated by reference in its entirety.

FIELD OF THE INVENTION

The present disclosure relates generally to hydrocarbon wells and associated methods that utilize radio frequency identification tags and flowable interrogators to interrogate the hydrocarbon wells.

BACKGROUND OF THE INVENTION

Obstructions may form in a hydrocarbon well in a variety of ways. As an example, dissolvable plugs may be utilized; however, it may be difficult to verify if and/or when the dissolvable plugs have dissolved; and, prior to dissolution, the dissolvable plugs may restrict fluid flow within the hydrocarbon well. As another example, a sand bridge may form proximate the dissolvable plugs and/or in another region of the hydrocarbon well. Formation of the sand bridge may decrease a cross-sectional area for fluid flow within the hydrocarbon well. As other examples, formation solids, scale, paraffin, wax, and/or other contaminants may accumulate within the hydrocarbon well, thereby obstructing fluid flow within the hydrocarbon well.

Obstructions historically have been detected via comparisons between an actual production rate from the hydrocarbon well and an expected production rate from the hydrocarbon well. While effective in certain circumstances, such detection mechanisms may be based upon a large number of assumptions and/or may provide very little information about a location and/or extent of the obstruction. As such, it may be difficult to select an appropriate cleanout methodology based solely on production rate data.

Chemical cleanout methodologies have been utilized to remove obstructions. While effective in certain circumstances, these chemical cleanout methodologies could more efficiently be performed if more accurate information was available about the nature, chemistry, extent, and/or location of obstructions.

More invasive obstruction detection methodologies also may be utilized. These more invasive detection methodologies generally require that a coiled tubing, a wireline, a workover rig with jointed pipe, and/or slickline-attached detector be deployed within the hydrocarbon well. Such invasive detection methodologies often are costly to implement and/or only may be effective with certain obstructions and/or certain downhole conditions.

Additional information regarding downhole conditions within the hydrocarbon well may be beneficial to, may improve, and/or may increase an efficiency of all of the above-described obstruction detection and/or cleanout methodologies. Thus, there exists a need for improved hydrocarbon wells and associated methods that utilize radio frequency identification tags and flowable interrogators to interrogate hydrocarbon wells.

SUMMARY OF THE INVENTION

Hydrocarbon wells and associated methods that utilize radio frequency identification (RFID) tags and flowable interrogators to interrogate the hydrocarbon wells. The hydrocarbon wells include a wellbore that may extend from a surface region and/or within a subsurface region. The hydrocarbon wells also include a downhole tubular that may define a tubular conduit and/or may extend within the wellbore. The hydrocarbon wells further include a plurality of RFID tags that may be spaced-apart along a length of the downhole tubular. Each RFID tag may be operatively attached to the downhole tubular and/or may be positioned within a corresponding predetermined tag region of the downhole tubular. The hydrocarbon wells also include a downhole interrogator storage structure that includes a plurality of flowable interrogators. The downhole interrogator storage structure may be configured to selectively release a given flowable interrogator responsive to a release criteria. The given flowable interrogator may be configured to flow from the downhole interrogator storage structure toward the surface region within a produced fluid stream that is produced from the hydrocarbon well. The given flowable interrogator may include an RFID transmitter, an RFID receiver, a data storage structure, and/or an interrogator-side communication device. The interrogator-side communication device may be configured to transmit a transmitted data stream. The hydrocarbon well also includes a well-side communication device, which may be configured to receive the transmitted data stream from the interrogator-side communication device.

The methods include releasing a flowable interrogator from a downhole interrogator storage structure and/or into a tubular conduit. The methods also include flowing the flowable interrogator within a produced fluid stream that flows within the tubular conduit. During the flowing, the methods also include interrogating an interrogated subset of a plurality of RFID tags with the flowable interrogator. The methods further include receiving a transmitted data stream from the flowable interrogator with a well-side communication device. The methods also include analyzing the transmitted data stream to determine at least one property of the hydrocarbon well.

DETAILED DESCRIPTION OF THE INVENTION

Figure 1:
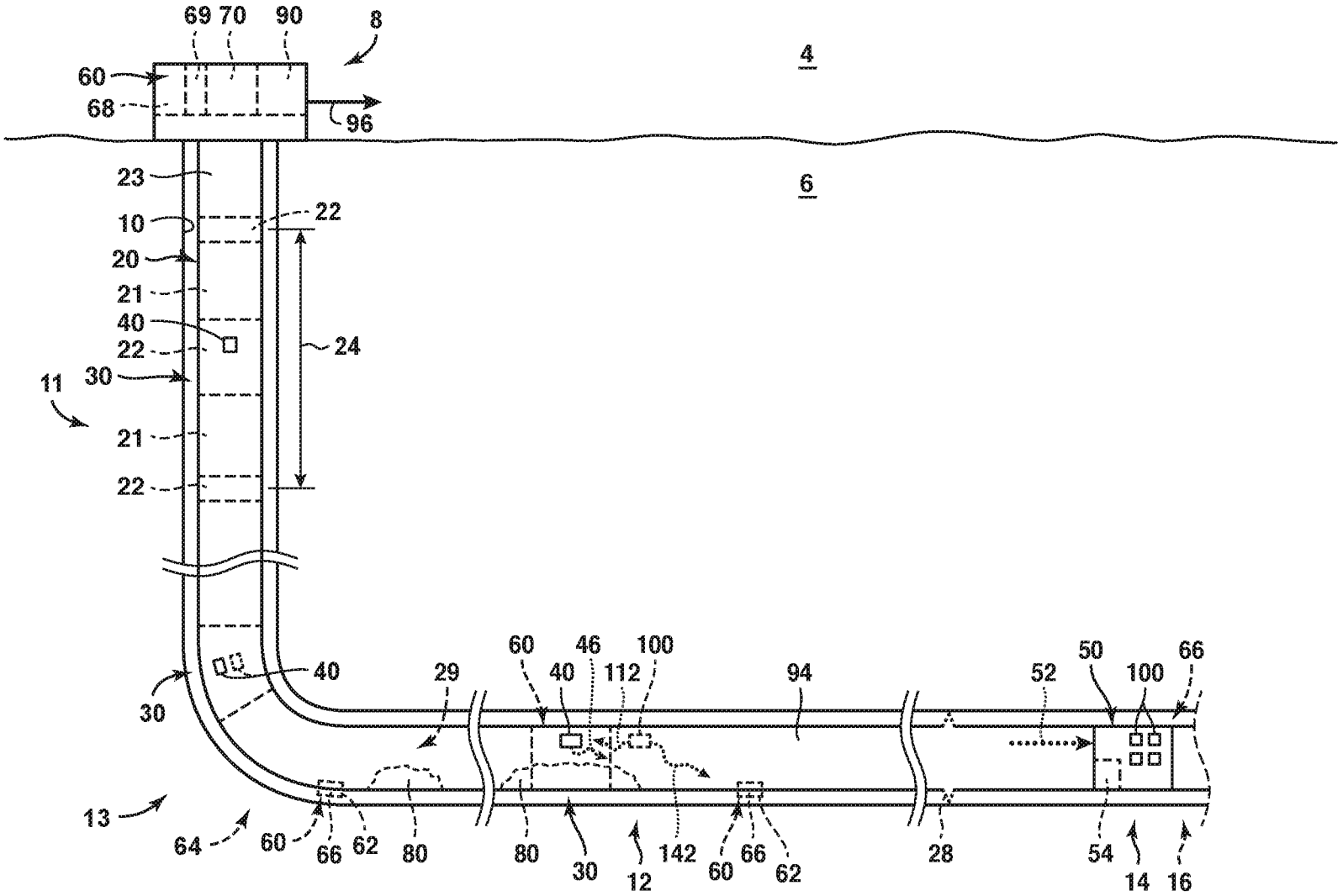
FIG. 1 is a schematic side view illustrating examples of a hydrocarbon well that may perform methods, according to the present disclosure.

FIGS. 1-6 provide examples of hydrocarbon wells 8 and/or of methods 200, according to the present disclosure. Elements that serve a similar, or at least substantially similar, purpose are labeled with like numbers in each of FIGS. 1-6, and these elements may not be discussed in detail herein with reference to each of FIGS. 1-6. Similarly, all elements may not be labeled in each of FIGS. 1-6, but reference numerals associated therewith may be utilized herein for consistency. Elements, components, and/or features that are discussed herein with reference to one or more of FIGS. 1-6 may be included in and/or utilized with any of FIGS. 1-6 without departing from the scope of the present disclosure.

In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic side view illustrating examples of a hydrocarbon well 8 that may perform methods 200, according to the present disclosure. As illustrated in solid lines in FIG. 1, hydrocarbon well 8 includes a wellbore 10, a downhole tubular 20, a plurality of radio frequency identification (RFID) tags 40, a downhole interrogator storage structure 50, and a well-side communication device 60. Wellbore 10 extends from a surface region 4 and within a subsurface region 6. Wellbore 10 also may be referred to herein as extending within the subsurface region and/or as extending between the surface region and a downhole end region 16. Downhole tubular 20 defines a tubular conduit 23 and extends within wellbore 10.

RFID tags 40 are spaced-apart along a length of downhole tubular 20. Each RFID tag 40 is operatively attached to the downhole tubular and is positioned within a corresponding predetermined tag region 30 of the downhole tubular. Downhole interrogator storage structure 50 includes a plurality of flowable interrogators 100 and may be configured to selectively release a given flowable interrogator of the plurality of flowable interrogators responsive to a release criteria, examples of which are disclosed herein.

Figure 5:
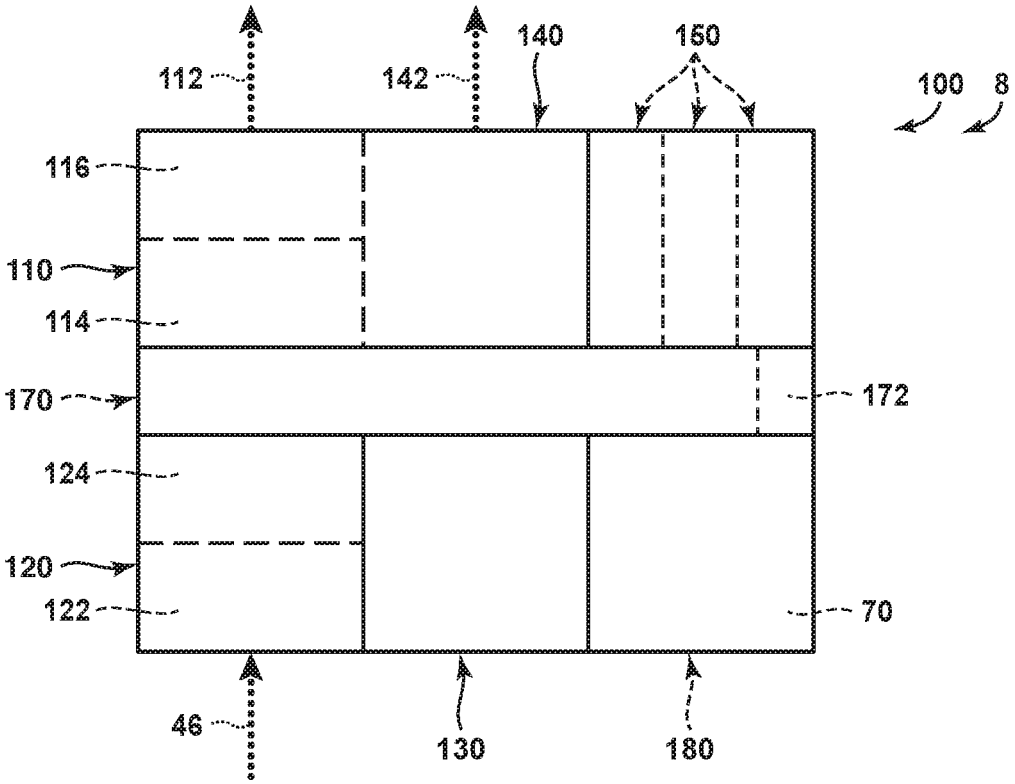
FIG. 5 is a schematic illustration of examples of a flowable interrogator that may be included in and/or utilized with the hydrocarbon wells and/or methods, according to the present disclosure.

As illustrated in FIG. 5, and discussed in more detail herein, the given flowable interrogator 100, or even each flowable interrogator of the plurality of flowable interrogators 100, includes an RFID transmitter 110, an RFID receiver 120, a data storage structure 130, and an interrogator-side communication device 140. RFID transmitter 110 may be configured to transmit an excitation signal 112; and, responsive to receipt of the excitation signal, each RFID tag 40 is configured to generate a corresponding resultant signal 46. RFID receiver 120 is configured to receive corresponding resultant signal 46, and data storage structure 130 is configured to store signal data that is representative and/or indicative of the corresponding resultant signal. Interrogator-side communication device 140 is configured to transmit a transmitted data stream 142 that is indicative of the signal data.

Returning to FIG. 1, hydrocarbon well 8 also includes well-side communication device 60. Well-side communication device 60 is configured to receive transmitted data stream 142 from the interrogator-side communication device of flowable interrogator 100.

Figure 6:
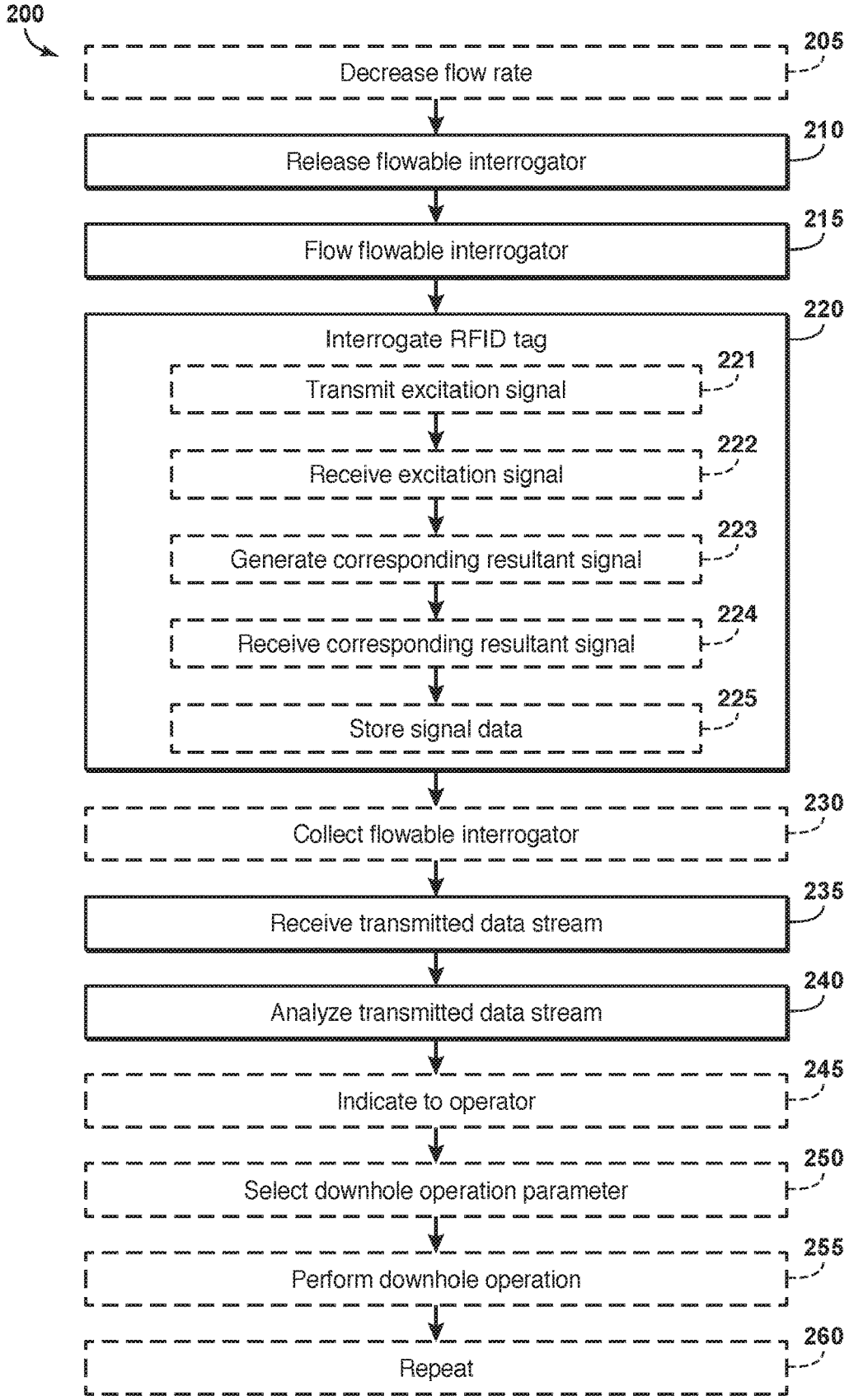
FIG. 6 is a flowchart depicting examples of methods of operating a hydrocarbon well, according to the present disclosure.

During operation of hydrocarbon wells 8, and as discussed in more detail herein with reference to methods 200 of FIG. 6, downhole interrogator storage structure 50 may release given flowable interrogator 100. As illustrated in dashed lines in FIG. 1, given flowable interrogator 100 may be configured to flow from downhole interrogator storage structure 50 and/or toward surface region 4, such as in and/or within a produced fluid stream 96 that may be produced from the hydrocarbon well.

As the given flowable interrogator flows toward surface region 4, the RFID transmitter of the given flowable interrogator transmits excitation signal 112. Excitation signal 112 is received by a given RFID tag 40; and responsive to receipt of the excitation signal, the given RFID tag emits and/or generates a corresponding resultant signal 46. The corresponding resultant signal is received by the RFID receiver of the given flowable interrogator, and the data storage structure of the given flowable interrogator stores signal data that is indicative of the corresponding resultant signal. The given flowable interrogator subsequently transmits transmitted data stream 142 to well-side communication device 60.

As discussed in more detail herein, the corresponding resultant signal, or signal data that is indicative of the corresponding resultant signal, may be indicative of at least one property of the hydrocarbon well. As an example, a change in a travel time needed for the excitation signal to travel from the given flowable interrogator to the given RFID tag and/or for the corresponding resultant signal to travel from the given RFID tag to the given flowable interrogator may be indicative of a distance between the given flowable interrogator and the given RFID tag. As another example, a rate of change of the travel time may be indicative of a velocity and/or of an acceleration of the given flowable interrogator within the tubular conduit. As such, the data stream may be utilized to produce and/or generate velocity and/or acceleration profiles within the tubular conduit.

In some examples, the velocity profile may include a fluid velocity profile within the tubular conduit. The fluid velocity profile may be utilized to calculate, to estimate, to determine, and/or to infer a reservoir inflow profile of reservoir fluids into the wellbore. As a more specific example, and assuming a constant and/or known cross-section for fluid flow within the wellbore, increases in fluid velocity as a function of location within the wellbore and/or as the flowable interrogator flows toward the surface region may be attributed to a flow of reservoir fluids into the wellbore. The reservoir inflow profile then may be utilized to quantify reservoir fluid production from various zone(s) of the subsurface region and/or to identify relatively higher producing zones and relatively lower producing zones.

As yet another example, a phase and/or an amplitude shift of the excitation signal, such as may be observed in the resultant signal, may be indicative of a material composition and/or mechanical properties of a media through which the excitation signal and/or the corresponding resultant signal travels between the given flowable interrogator and the given RFID tag. As such, the data stream may be utilized to produce and/or generate material composition and/or mechanical property information regarding material(s) that may be present within the hydrocarbon well. In addition, knowledge of a location of the given flowable interrogator and/or of the given RFID tag may permit the generated material composition and/or mechanical property information to be correlated to a specific location and/or region within the hydrocarbon well.

As yet another example, periodic release of one or more flowable interrogators may provide information regarding a time evolution of, for example, velocity profiles, acceleration profiles, material compositions, and/or mechanical properties within the hydrocarbon well. This time evolution may be utilized to monitor and/or to predict formation of an obstruction within the hydrocarbon well, a location of the obstruction within the hydrocarbon well, and/or material properties of the obstruction. This information then may be utilized to select timing and/or functional details of a cleanout operation that may be utilized to remove the obstruction from the hydrocarbon well.

Downhole interrogator storage structure 50 also may be referred to herein as storage structure 50 and may include any suitable structure that may be adapted, configured, designed, and/or constructed to include flowable interrogators 100 and/or to selectively release flowable interrogators 100. In some examples, storage structure 50 may be operatively attached to, may be at least partially defined by, and/or may form a portion of a plug, or of a downhole plug, that may be included in and/or utilized with the hydrocarbon well. In some examples, storage structure 50 may be operatively attached to, may be at least partially defined by, and/or may form a portion of a completion device that may be utilized during completion operations performed on the hydrocarbon well. In some examples, storage structure 50 may be operatively attached to, may be at least partially defined by, and/or may form a portion of a post-completion device that may be utilized and/or installed subsequent to completion of the hydrocarbon well.

Storage structure 50 may be positioned, placed, located, and/or present at any suitable location in and/or within hydrocarbon well 8 and/or wellbore 10 thereof. As an example, storage structure 50 may be positioned in, within, proximate, and/or near downhole end region 16. As another example, storage structure 50 may be positioned in, within, proximate, and/or near a horizontal, or a deviated, region 12 of the wellbore. Deviated region 12 may extend between a heel region 13 and a toe region 14 of the wellbore. When the storage structure is positioned within deviated region 12, the storage structure may be proximate heel region 13, may be proximate toe region 14, and/or may be positioned between the heel region and the toe region. As illustrated in FIG. 1, deviated region 12 may include and/or define toe region 14, and downhole end region 16 may be included in and/or may be proximate toe region 14. As yet another example, hydrocarbon well 8 may include a vertical region 11 that may include and/or define the downhole end region.

In some examples, hydrocarbon well 8 includes a single storage structure 50. In some examples, hydrocarbon well 8 includes a plurality of storage structures 50, which may be spaced-apart along the length of the downhole tubular. In these examples, each storage structure 50 may include at least one flowable interrogator 100, or even a plurality of flowable interrogators 100. Such a configuration may facilitate, or may facilitate more accurate, determination of region (s) of the hydrocarbon well that include obstruction(s) 80.

As an example, and when obstruction 80 completely blocks fluid flow therepast, there may be very little, or no, fluid flow within a region of the wellbore that is downhole from the obstruction. As such, a flowable interrogator 100 that is released downhole from the obstruction may not flow, or move, within the wellbore and/or toward the surface region. Such a flowable interrogator still may, in some examples, communicate with detection structure and/or it may be possible to determine that the obstruction is uphole from the flowable interrogator. However, the lack of motion of the flowable interrogator may dictate that release of the flowable interrogator provides very little quantitative information about a location of the obstruction within the wellbore.

However, when the hydrocarbon well includes another storage structure 50 that is uphole from obstruction 80, flowable interrogators 100 that are released from this storage structure 50 may flow within the wellbore and/or toward the surface region. This flow may be relied upon to indicate that obstruction 80 is downhole from this storage structure 50, thereby identifying a specific, or at least a more specific, region of the wellbore that includes the obstruction.

As discussed, storage structure 50 may be configured to selectively release given flowable interrogator 100 responsive to a release criteria. An example of the release criteria includes an interrogator release signal 52, which may be received by the storage structure. Examples of the interrogator release signal include any suitable wired, wireless, electromagnetic, acoustic, and/or pressure pulse interrogator release signal that may be conveyed to the storage structure in any suitable manner and/or via any suitable mechanism and/or medium.

As another example, the release criteria may include an indication, such as by an operator of the hydrocarbon well, to release the given flowable interrogator. In a more specific example, the operator may generate the interrogator release signal and/or may cause the interrogator release signal to be generated, and the interrogator release signal may function as and/or may be the indication to release the given flowable interrogator.

As another example, the release criteria may include expiration of a threshold interrogator release time interval. As yet another example, the release criteria may include at least one bottom hole condition, such as may be measured by the downhole interrogator storage structure, being within a threshold bottom hole condition range. As another example, the release criteria may include a downhole temperature being within a threshold downhole temperature range, above a threshold temperature value, and/or below the threshold temperature value. As yet another example, the release criteria may include a downhole pressure being within a threshold downhole pressure range, above a threshold pressure value, and/or below the threshold pressure value. As another example, the release criteria may include production of a predetermined volume of produced fluid by the hydrocarbon well. As yet another example, the release criteria may include a flow rate of the produced fluid stream being within a threshold flow rate range, above a threshold flow rate value, and/or below the threshold flow rate value. As another example, the release criteria may include dissolution of at least a predetermined region of the downhole interrogator storage structure, such as within a wellbore fluid 94 that extends within the wellbore.

Storage structure 50 may release the given flowable interrogator in any suitable manner and/or utilizing any suitable mechanism. As an example, storage structure 50 may include a release mechanism 54, which may be configured to release, or to facilitate release of, the given flowable interrogator. Examples of release mechanism 54 include an electric release mechanism, an electric actuator, a pump, a hydraulic release mechanism, and/or a mechanical release mechanism. Another example of release mechanism 54 includes a soluble region of storage structure 50. The soluble region may be configured to dissolve, solvate, and/or corrode responsive to fluid contact with wellbore fluid 94; and the given flowable interrogator may be released responsive to, or as a result of, this dissolution, solvation, and/or corrosion.

Well-side communication device 60 may include any suitable structure that may be adapted, configured, designed, constructed, and/or programmed to receive transmitted data stream 142 from flowable interrogator 100. Examples of well-side communication device 60 include an acoustic well-side transmitter, an acoustic well-side receiver, an optical well-side transmitter, an optical well-side receiver, an electromagnetic well-side transmitter, and/or an electromagnetic well-side receiver.

In some examples, well-side communication device 60 may include and/or be a downhole well-side communication device 62, which may be configured to receive the transmitted data stream while the flowable interrogator is positioned within the subsurface region. An example of downhole well-side communication device 62 includes a downhole wireless network 64, which may include and/or may be defined by a plurality of communication nodes 66 that may be spaced-apart along a length of downhole tubular 20. In some such examples, storage structure 50 may form and/or define at least a portion, such as a communication node 66 of the downhole wireless network.

In some examples, the well-side communication device includes an uphole well-side communication device 68. The uphole well-side communication device may be configured to receive the transmitted data stream subsequent to the flowable interrogation device being produced from the subsurface region, such as in and/or within produced fluid stream 96. In some such examples, well-side communication device 60 may include a collection structure 69, which may be configured to separate the flowable interrogator from the produced fluid stream. Examples of the collection structure include a screen, a filter, and/or a magnetic assembly.

As illustrated in dashed lines in FIG. 1, hydrocarbon well 8 may include a signal processing assembly 70. Signal processing assembly 70, when present, may be adapted, configured, and/or programmed to process the signal data and/or transmitted data stream 142. In some examples, signal processing assembly 70 may be included in and/or may form a portion of flowable interrogator 100. In some examples, signal processing assembly 70 may be separate, distinct, and/or spaced-apart from the flowable interrogator.

In some examples, signal processing assembly 70 may be adapted, configured, and/or programmed to identify an obstruction 80 within the hydrocarbon well and/or based, at least in part on the signal data and/or on the transmitted data stream. As more specific examples, the signal processing assembly may be programmed to estimate a location of an obstruction within the tubular conduit, to indicate formation of the obstruction within the tubular conduit, and/or to estimate at least one physical property of the obstruction within the tubular conduit.

In some examples, signal processing assembly 70 may be adapted, configured, and/or programmed to respond to formation of obstruction 80. As more specific examples, the signal processing assembly may be programmed to indicate, to an operator of the hydrocarbon well, that a cleanout operation should be performed on the hydrocarbon well and/or to indicate, to the operator of the hydrocarbon well, a location at which the cleanout operation should be performed within the hydrocarbon well.

In some examples, and as discussed in more detail herein, storage structure 50 may be configured to release, or to sequentially release, a plurality of released flowable interrogators 100. In these examples, well-side communication device 60 may be configured to receive a corresponding transmitted data stream from each of the released flowable interrogators and/or signal processing assembly 70 may be programmed to determine at least one property of the hydrocarbon well based, at least in part, on a change in the corresponding transmitted data stream between sequentially released flowable interrogators. Stated another way, signal processing assembly 70 may be configured to observe and/or to quantify changes, or time-based changes, in the corresponding transmitted data stream among the plurality of released flowable interrogators and/or to utilize this information to determine the at least one property of the hydrocarbon well. In such a configuration, examples of the at least one property of the hydrocarbon well include formation of the obstruction and/or growth characteristic, or growth kinetics, of the obstruction.

As illustrated in dashed lines in FIG. 1, hydrocarbon well 8 may include a flow-regulating structure 90. Flow-regulating structure 90, when present, may be adapted, configured, designed, and/or constructed to selectively regulate a flow rate of produced fluid stream 96. In some examples, flow-regulating structure 90 may be configured to selectively decrease the flow rate of the produced fluid stream subsequent to release of the flowable interrogator by storage structure 50 and/or while the flowable interrogator flows from storage structure 50 toward and/or to surface region 4. Such a configuration may improve a data resolution of information collected by the flowable interrogator.

Downhole tubular 20 may include any suitable structure that may define tubular conduit 23 and/or to which RFID tags 40 may be operatively attached. Examples of downhole tubular 20 include a pipe and/or a jointed pipe.

Figure 2:
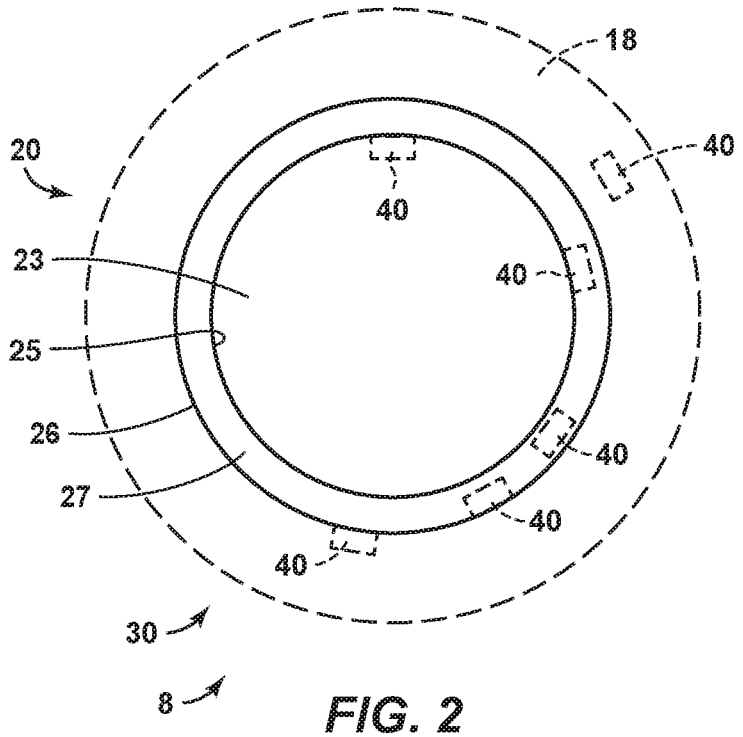
FIG. 2 is a schematic cross-sectional view of a downhole tubular that may be utilized in the hydrocarbon well of FIG. 1.

RFID tags 40 may be operatively attached to downhole tubular 20 in any suitable manner that may cause the RFID tags, or a location of the RFID tags, to be fixed, or at least substantially fixed, in space, with respect to wellbore 10, and/or with respect to downhole tubular 20. FIG. 2 is a schematic cross-sectional view of a downhole tubular 20 that may be utilized in the hydrocarbon well of FIG. 1.

As illustrated in FIG. 2, RFID tags 40 may be operatively attached to an inside diameter 25 and/or to an outside diameter 26 of the downhole tubular. This may include RFID tags that project from the inside diameter, that project from the outside diameter, and/or that are embedded within the downhole tubular such that the RFID tags define at least a region of the inside diameter and/or at least a region of the outside diameter. As also illustrated in FIG. 2, RFID tags 40 may be embedded within a wall 27 of the downhole tubular and/or may be positioned between the inside diameter and the outside diameter of the downhole tubular. As also illustrated in FIG. 2, RFID tags 40 may be embedded within a cement 18 that may operatively attach the RFID tags to the downhole tubular.

A subset of the plurality of RFID tags 40 may be positioned within each corresponding predetermined tag region 30 of the downhole tubular. Each corresponding predetermined tag region 30 of the downhole tubular may include any suitable number of RFID tags 40. In some examples, each corresponding predetermined tag region 30 may include a single, or only one, RFID tag 40. In some examples, hydrocarbon well 8 may include a different number of RFID tags 40 in some predetermined tag regions 30 when compared to other predetermined tag regions 30. In some examples, each corresponding predetermined tag region 30 may include a plurality of RFID tags 40. Examples of the plurality of RFID tags include at least 2, at least 3, at least 4, at least 5, at most 10, at most 8, at most 6, and/or at most 4 RFID tags.

Figure 3:
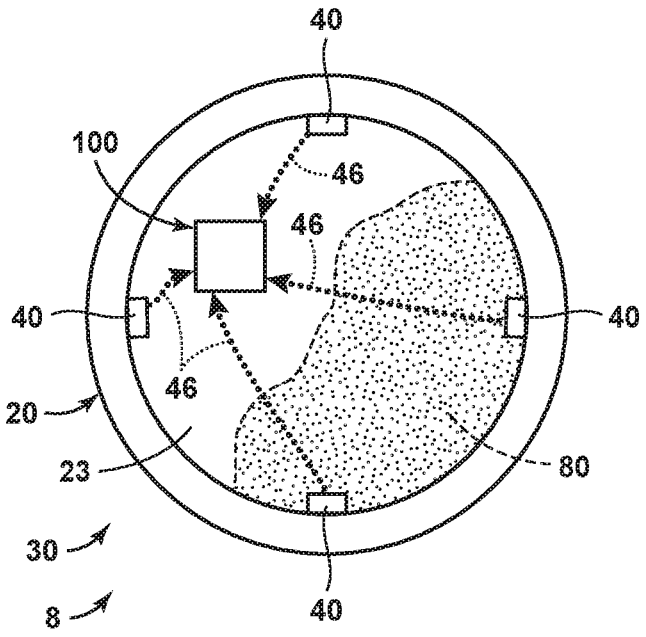
FIG. 3 is a schematic cross-sectional view of a downhole tubular that may be utilized in the hydrocarbon well of FIG. 1.

When hydrocarbon wells 8 include the plurality of RFID tags 40 within a given predetermined tag region 30, the plurality of RFID tags 40 may be positioned in any suitable orientation, or relative orientation. As an example, and as illustrated in FIG. 3, the plurality of RFID tags 40 may be spaced-apart, equally spaced-apart, or at least substantially equally spaced-apart around a circumference of the downhole tubular. As another example, the plurality of RFID tags may be positioned within, or within a single, transverse cross-section of the downhole tubular and/or the circumference of the downhole tubular may be defined within the transverse cross-section of the downhole tubular.

Inclusion of the plurality of RFID tags 40 within a given predetermined tag region 30 may provide additional information when compared to hydrocarbon wells 8 that utilize only a single RFID tag 40 in each predetermined tag region 30. As an example, inclusion of the plurality of RFID tags 40 may improve data resolution, such as to provide additional information about the acceleration of the flowable interrogator and/or the velocity of the flowable interrogator within a transverse cross-section of the tubular conduit. As another example, inclusion of the plurality of RFID tags may provide additional information about obstructions that may be present within the tubular conduit.

As yet another example, and as illustrated in FIG. 3, flowable interrogator 100 may receive a corresponding resultant signal 46 from each RFID tag 40 of the plurality of RFID tags 40 positioned within the given predetermined tag region 30. Such a configuration may provide additional information regarding a position of the flowable interrogator within the transverse cross-section of the tubular conduit, such as via triangulation of the location of the flowable interrogator relative to the plurality of RFID tags 40.

Such a configuration additionally or alternatively may permit determination of at least one property of an obstruction 80 that is proximate and/or within the given predetermined tag region 30. As an example, and as illustrated in FIG. 3, the flowable interrogator may be excluded from, or unable to flow through, a region of tubular conduit 23 that includes obstruction 80. As another example, resultant signals 46 that travel through obstruction 80 may be modified, such as via phase and/or amplitude shifts, when compared to resultant signals 46 that do not travel through the obstruction. This modification may provide additional information regarding material properties of the obstruction.

It is within the scope of the present disclosure that predetermined tag regions 30 may have any suitable orientation, or relative orientation, within hydrocarbon well 8 and/or along the length of downhole tubular 20. As an example, predetermined tag regions 30 may be spaced-apart along the length of the downhole tubular. In such a configuration, a distance between each predetermined tag region and an adjacent predetermined tag region may be at least 1 meter (m), at least 5 m, at least 6 m, at least 8 m, at least 10 m, at least 12 m, at least 14 m, at least 16 m, at least 18 m, at least 20 m, at least 30 m, at least 40 m, at least 60 m, at least 80 m, at most 100 m, at most 80 m, at most 60 m, at most 40 m, at most 20 m, at most 18 m, at most 16 m, at most 14 m, at most 12 m, and/or at most 10 m.

In some examples, the distance between each predetermined tag region and the adjacent predetermined tag region may be equal, or at least substantially equal, for each predetermined tag region 30. As an example, the downhole tubular may include a plurality of tubing segments 21 and a plurality of tubing couplers 22, and each tubing coupler may operatively couple two adjacent tubing segments to one another. In such a configuration, the distance between each predetermined tag region and the adjacent predetermined tag region may be equal, or at least substantially equal, to an integer multiple of a joined length 24 of tubing segments 21. Joined length 24 may be defined as a center-to-center distance between adjacent tubing couplers 22.

In some examples, each tubing segment 21 and/or each tubing coupler 22 may include and/or may be associated with a corresponding predetermined tag region 30. In some examples, a subset, or fewer than all, of the tubing segments and/or tubing couplers may include and/or be associated with a corresponding predetermined tag region. In some examples, RFID tags 40 may be operatively attached to and/or incorporated into tubing segments 21. In some examples, RFID tags 40 may be operatively attached to and/or incorporated into tubing couplers 22.

Examples of tubing couplers 22 include threaded tubing couplers, casing collars, and/or production tubing collars. Examples of tubing segments 21 include casing segments and/or production tubing segments.

In some examples, RFID tags 40 may have a consistent, or an at least substantially consistent, orientation and/or position within predetermined tag regions 30. As an example, a location of each RFID tag in and/or within the corresponding predetermined tag region may be at least substantially equal for each RFID tag of the hydrocarbon well. As another example, an orientation of each RFID tag within and/or relative to a transverse cross-section of the downhole tubular and/or a centerline of the downhole tubular may be at least substantially equal for each RFID tag of the hydrocarbon well. Such configurations may facilitate improved data interpretation, such as by providing more consistent and/or repeatable transmission of excitation signal 112 and/or of resultant signal 46 from the RFID tags.

Figure 4:
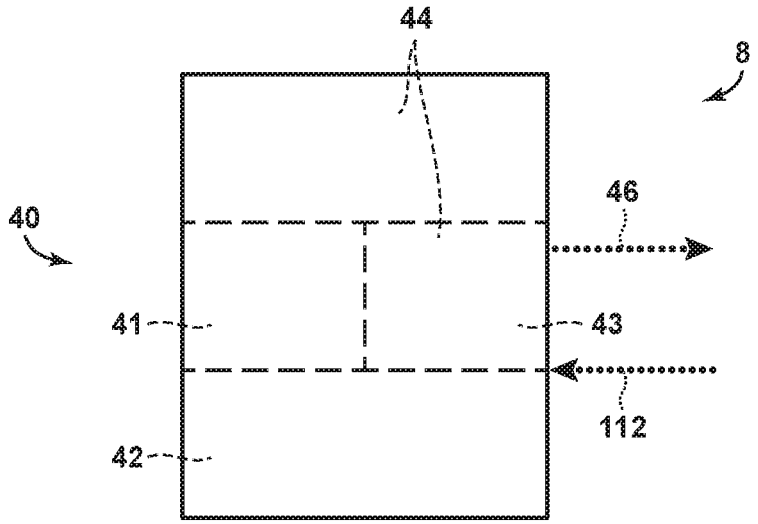
FIG. 4 is a schematic illustration of examples of a radio frequency identification tag that may be included in and/or utilized with the hydrocarbon wells and/or methods, according to the present disclosure.

FIG. 4 is a schematic illustration of examples of an RFID tag 40 that may be included in and/or utilized with the hydrocarbon wells 8 and/or methods 200, according to the present disclosure. FIG. 4 may be a more detailed illustration of RFID tags 40 that are illustrated in FIGS. 1-3. With this in mind, any suitable structure, function, and/or feature of RFID tags 40 that is discussed herein with reference to FIG. 4 may be included in and/or utilized with RFID tags 40 of FIGS. 1-3 without departing from the scope of the present disclosure. Similarly, any suitable structure, function, and/or feature of RFID tags 40 that is discussed herein with reference to FIGS. 1-3 may be included in and/or utilized with RFID tags 40 of FIG. 4 without departing from the scope of the present disclosure.

As discussed, RFID tags 40 may be configured to receive excitation signal 112 and, responsive to receipt of the excitation signal, generate a corresponding resultant signal 46. This may be accomplished in any suitable manner. As examples, RFID tags 40 may modify the excitation signal to generate the corresponding resultant signal and/or may reflect the excitation signal to generate the corresponding resultant signal.

In some examples, and as illustrated in dashed lines in FIG. 4, RFID tags 40 may include an RFID tag processor 41. RFID tag processor 41, when present, may be configured to control the operation of the RFID tag and/or of at least one other component of the RFID tag. As an example, RFID tag processor 41 may control and/or regulate how the RFID tag modifies the excitation signal to generate the resultant signal.

In some examples, and as also illustrated in dashed lines in FIG. 4, RFID tags 40 may include an RFID tag memory device 42. RFID tag memory device 42, when present, may be configured to store a unique identifier that may uniquely identify the RFID tag and/or may permit resultant signal 46 that is produced by the RFID tag to be associated with the RFID tag and/or to be distinguished from resultant signals that maybe produced by other RFID tags.

In some examples, and as also illustrated in dashed lines in FIG. 4, RFID tags 40 may include an RFID tag antenna 43. RFID tag antenna 43, when present, may be configured to receive excitation signal 112 and/or to transmit resultant signal 46.

In some examples, and as also illustrated in dashed lines in FIG. 4, RFID tags 40 may include an RFID tag power source 44. RFID tag power source 44, when present, may be configured to power at least one other component of the RFID tag, such as RFID tag processor 41 and/or RFID tag memory device 42. Examples of RFID tag power source 44 include an energy storage device, a battery, a capacitor, and/or an energy harvesting structure. Another example of RFID tag power source 44 includes RFID tag antenna 43, which may be configured to power the RFID tag responsive to receipt of the excitation signal.

As discussed, RFID tags 40 may include a unique identifier, such as may be stored by RFID tag memory device 42. As also discussed, the unique identifier may uniquely identify, or may uniquely distinguish, a given RFID tag, or a resultant signal that is transmitted from the given RFID tag, from another, or even from every other, RFID tag, or resultant signals, that are transmitted from the other, or even from every other, RFID tag. When RFID tags 40 include the unique identifier, the RFID tags may be configured to modify the excitation signal and/or to produce the resultant signal such that the resultant signal includes, or is based upon, the unique identifier. As such, the unique identifier may be communicated from the RFID tags to the flowable interrogator and/or from the flowable interrogator to the well-side communication device.

Incorporation of the unique identifier into RFID tags 40 may provide several benefits. As an example, the unique identifier may be associated with a given predetermined tag region and/or may be utilized to identify a location, within the wellbore and/or along the downhole tubular, where a given resultant signal was received by the flowable interrogator. As another example, knowledge of the unique identifier may improve interpretation of the transmitted data stream, such as via identification of predetermined tag region(s) in which the interrogation device may not have received the resultant signal.

FIG. 5 is a schematic illustration of examples of a flowable interrogator 100 that may be included in and/or utilized with the hydrocarbon wells 8 and/or methods 200, according to the present disclosure. FIG. 5 may be a more detailed illustration of flowable interrogators 100 that are illustrated in FIGS. 1-3. With this in mind, any suitable structure, function, and/or feature of flowable interrogators 100 that is discussed herein with reference to FIG. 5 may be included in and/or utilized with flowable interrogators 100 of FIGS. 1-3 without departing from the scope of the present disclosure. Similarly, any suitable structure, function, and/or feature of flowable interrogators 100 that is discussed herein with reference to FIGS. 1-3 may be included in and/or utilized with flowable interrogators 100 of FIG. 5 without departing from the scope of the present disclosure.

As discussed, flowable interrogators 100 include an RFID transmitter 110, which may be configured to transmit an excitation signal 112. RFID transmitter 110 may include any suitable structure that may, that may be utilized to, and/or that may be configured to produce, generate, and/or transmit the excitation signal. As examples, RFID transmitter 110 may include an RF generator 114, which may be configured to generate the excitation signal, and/or an RF transmitter antenna 116, which may be configured to transmit the excitation signal.

In some examples, RFID transmitter 110 may be configured to intermittently, periodically, repeatedly, and/or occasionally transmit the excitation signal as the flowable interrogator flows toward the surface region within the produced fluid stream. As a more specific example, the RFID transmitter may "ping" RFID tags 40 when the RFID transmitter is at one or more predetermined locations within the tubular conduit. In some examples, the RFID transmitter may be configured to continuously, or at least substantially continuously, transmit the excitation signal as the flowable interrogator flows toward the surface region within the produced fluid stream.

As also discussed, flowable interrogators 100 include an RFID receiver 120, which may be configured to receive corresponding resultant signal 46. RFID receiver 120 may include any suitable structure that may, that may be utilized to, and/or that may be configured to receive the corresponding resultant signal. Examples of RFID receiver 120 may include an RF receiver antenna 122, which may be configured to receive the corresponding resultant signal, and/or an RF signal processor 124, which may be configured to process and/or to analyze the corresponding resultant signal. In some examples, RFID receiver 120 may be at least partially defined by RFID transmitter 110. As a more specific example, RF receiver antenna 122 may include and/or be RF transmitter antenna 116 of the RFID transmitter.

As also discussed, flowable interrogators 100 include a data storage structure 130, which may be configured to store signal data that is representative and/or indicative of the corresponding resultant signal. Data storage structure 130 may include any suitable structure that may, that may be utilized to, and/or that may be configured to store the data indicative of the corresponding resultant signal. Examples of data storage structure 130 include a memory device, a solid state memory device, a volatile memory device, and/or a non-volatile memory device.

In some examples, data storage structure 130 may be configured to store time-based signal data indicative of a value of the corresponding resultant signal as a function of time. In such examples, flowable interrogator 100 and/or data storage structure 130 thereof may associate a time stamp, or a series of time stamps, with the signal data. In some examples, data storage structure 130 may be configured to store location-based signal data indicative of a value of the corresponding resultant signal as a function of location within the wellbore. In such examples, flowable interrogator 100 and/or data storage structure 130 thereof may associate a location, or a series of locations, with the signal data. In some examples, data storage structure 130 may be configured to associate the signal data with a corresponding RFID tag that generated the corresponding resultant signal. In such examples, flowable interrogator 100 and/or data storage structure 130 thereof may associate the unique identifier of the corresponding RFID tag with the signal data.

As also discussed, flowable interrogators 100 include an interrogator-side communication device 140, which may be configured to transmit a transmitted data stream 142 that is indicative of the signal data. Interrogator-side communication device 140 may include any suitable structure that may, that may be utilized to, and/or that may be configured to transmit the transmitted data signal. In some examples, the interrogator-side communication device may be distinct and/or separate from the RFID transmitter and/or from the RFID receiver. In some examples, the interrogator-side communication device may be at least partially, or even completely, defined by the RFID transmitter and/or by the RFID receiver. Examples of the interrogator-side communication device include an acoustic interrogator-side transmitter, an acoustic interrogator-side receiver, an optical interrogator-side transmitter, an optical interrogator-side receiver, an electromagnetic interrogator-side transmitter, and/or an electromagnetic interrogator-side receiver.

As illustrated in dashed lines in FIG. 5, flowable interrogators 100 may include an electrical power source 170. Electrical power source 170, when present, may be configured to electrically power at least one other component of the flowable interrogator. Examples of the at least one other component of the flowable interrogator include RFID transmitter 110, RFID receiver 120, data storage structure 130, and/or interrogator-side communication device 140. Examples of electrical power source 170 include a battery, a capacitor, and/or an energy harvesting structure.

In some examples, flowable interrogator 100 and/or electrical power source 170 thereof may include an initiation structure 172. Initiation structure 172, when present, may be configured to initiate electrical power of the flowable interrogator responsive to fluid contact between the flowable interrogator and the wellbore fluid. Examples of the initiation structure include a material that becomes electrically conductive upon fluid contact with the wellbore fluid and/or a pair of electrical contacts separated by a material that is soluble within the wellbore fluid.

As also illustrated in dashed lines in FIG. 5, flowable interrogators 100 may include an interrogator-side processing structure 180. Interrogator-side processing structure 180, when present, may be adapted, configured, and/or programmed to convert the corresponding resultant signal into the signal data, to convert the signal data into the transmitted data stream, and/or to control the operation of at least one other component of the flowable interrogator. In some examples, interrogator-side processing structure 180 may include and/or be signal processing assembly 70, which is discussed in more detail herein with reference to FIG. 1.

As also illustrated in dashed lines in FIG. 5, flowable interrogators 100 may include at least one sensor 150. Sensor 150, when present, may be configured to detect, determine, and/or measure any suitable sensed parameter and/or property within the hydrocarbon well. This may include making a single, or an instantaneous, measurement of the sensed parameter and/or property within the hydrocarbon well and/or collecting a series of measurements, which may be location-based measurements and/or time-based measurements, within the hydrocarbon well.

An example of sensor 150 includes a magnetometer. The magnetometer may be configured to determine, or the sensed parameter may be, at least one property of a magnetic field within the wellbore. In this example, transmitted data stream 142 may include information regarding the at least one property of the magnetic field within the wellbore.

Another example of sensor 150 includes a coupling locator. The coupling locator may be configured to detect, or the sensed parameter may be, motion of the flowable interrogator past tubing couplers of the downhole tubular. In this example, the transmitted data stream may include information regarding motion of the flowable interrogator past tubing couplers of the downhole tubular.

Another example of sensor 150 includes an ultrasonic sensor. The ultrasonic sensor may be configured to detect, or the sensed parameter may be, an ultrasonic signature within the wellbore. In this example, the transmitted data stream may include information regarding the ultrasonic signature within the wellbore.

Another example of sensor 150 includes an imaging device. The imaging device may be configured to detect, or the sensed parameter may be, at least one image of the wellbore. In this example, the transmitted data stream may include information regarding the at least one image of the wellbore.

Another example of sensor 150 includes a temperature sensor. The temperature sensor may be configured to detect, or the sensed parameter may be, a downhole temperature within the wellbore. In this example, the transmitted data stream may include information regarding the downhole temperature within the wellbore.

Another example of sensor 150 includes a pressure sensor. The pressure sensor may be configured to detect, or the sensed parameter may be, a downhole pressure within the wellbore. In this example, the transmitted data stream may include information regarding the downhole pressure within the wellbore.

Another example of sensor 150 includes a pH sensor. The pH sensor may be configured to detect, or the sensed parameter may be, a pH within the wellbore. In this example, the transmitted data stream may include information regarding the pH within the wellbore.

Another example of sensor 150 includes a vibration sensor. The vibration sensor may be configured to detect, or the sensed parameter may be, vibration within the wellbore. In this example, the transmitted data stream may include information regarding the vibration within the wellbore.

As another example, sensor 150 may include an accelerometer. The accelerometer may be configured to detect, or the sensed parameter may be, acceleration of the flowable interrogator within the wellbore. In this example, the transmitted data stream may include information regarding the acceleration of the flowable interrogator within the wellbore.

As another example, sensor 150 may include a velocimeter. The velocimeter may be configured to detect, or the sensed parameter may be, a velocity of the flowable interrogator within the wellbore. In this example, the transmitted data stream may include information regarding the velocity of the flowable interrogator within the wellbore.

Flowable interrogators 100 may include and/or define any suitable size, weight, specific gravity, and/or shape. As examples, flowable interrogators 100 may be sized to flow within the tubular conduit and/or may be sized to flow within an at least partially obstructed region of the tubular conduit, as indicated in FIG. 1 at 29. As additional examples, flowable interrogators 100 may be sized to decrease a potential for hydraulic adherence to perforations 28 within the downhole tubular and/or may be sized to define an interrogator maximum extent that is greater than a perforation maximum extent of the perforations.

As another example, flowable interrogators 100 may be shaped to be entrained within the produced fluid stream. As more specific examples, the flowable interrogators may define a large surface area to volume ratio and/or may define a region that is shaped to facilitate entrainment within the produced fluid stream, such as a parachute-shaped region, a sail-shaped region, and/or a kite-shaped region.

In some examples, the flowable interrogators may be positively buoyant within the produced fluid stream and/or density ratio of a density of the flowable interrogator to a density of the produced fluid stream may be less than 1. Such a configuration may cause the flowable interrogators to float and/or flow within and/or near an uppermost region of the tubular conduit. In some examples, the flowable interrogators may be neutrally buoyant within the produced fluid stream and/or the density ratio may be equal to, may be at least substantially equal to 1, and/or may be between 0.95 and 1.05. Such a configuration may cause the flowable interrogators to float and/or flow within a central region of the tubular conduit. In some examples, the flowable interrogators may be negatively buoyant within the produced fluid stream and/or the density ratio may be greater than 1. Such a configuration may cause the flowable interrogators to float and/or flow within and/or near a lowermost region of the tubular conduit.

Selection of a specific buoyancy (e.g., negatively buoyant, neutrally buoyant, and/or positively buoyant) for a given flowable interrogator and/or within a given hydrocarbon well may provide additional flexibility regarding which region(s) of the tubular conduit may be probed by the flowable interrogator, may decrease a potential for the flowable interrogator to become trapped within the hydrocarbon well, and/or may increase a potential for the flowable interrogator to be produced from the hydrocarbon well within the produced fluid stream.

As an example, in a hydrocarbon well that is toe-up, selection of negatively buoyant flowable interrogators may decrease a potential for the flowable interrogators to become trapped within the toe of the wellbore. As another example, release of different flowable interrogators with different buoyancies within a given hydrocarbon well may permit and/or facilitate flow of the different flowable interrogator within and/or through different regions of the hydrocarbon well, thereby permitting and/or facilitating data collection within the different regions of the hydrocarbon well.

FIG. 6 is a flowchart depicting examples of methods 200 of operating a hydrocarbon well, according to the present disclosure, such as hydrocarbon well 8 of FIGS. 1-5. The hydrocarbon well includes a wellbore that extends within a subsurface region and a downhole tubular that extends within the wellbore and defines a tubular conduit. The hydrocarbon well also includes a plurality of radio frequency identification (RFID) tags spaced-apart along a length of the downhole tubular.

Methods 200 may include decreasing a flow rate at 205 and include releasing a flowable interrogator at 210, flowing the flowable interrogator at 215, and/or interrogating an RFID tag at 220. Methods 200 also may include collecting the flowable interrogator at 230 and include receiving a transmitted data stream at 235 and analyzing the transmitted data stream at 240. Methods 200 further may include indicating to an operator at 245, selecting a downhole operation parameter at 250, performing a downhole operation at 255, and/or repeating at 260.

Decreasing the flow rate at 205 may include selectively decreasing a flow rate of a produced fluid stream that is produced from the hydrocarbon well. The decreasing at 205 may be performed prior to, during, and/or at least partially concurrently with the flowing at 215. This may decrease a speed and/or a velocity of the flowable interrogator, which may increase an accuracy, a reliability, and/or a repeatability of the interrogating at 220, the collecting at 230, and/or the analyzing at 240.

Releasing the flowable interrogator at 210 may include releasing the flowable interrogator from a downhole interrogator storage structure, releasing the flowable interrogator into the tubular conduit, and/or releasing the flowable interrogator into a wellbore fluid that extends within the tubular conduit. Examples of the downhole interrogator storage structure are disclosed herein with reference to downhole interrogator storage structures 50 of FIG. 1. Examples of the flowable interrogator are disclosed herein with reference to flowable interrogators 100 of FIGS. 1 and 3-4. In some examples, the releasing at 210 may include releasing at least partially responsive to a release criteria. Examples of the release criteria are disclosed herein.

Flowing the flowable interrogator at 215 may include flowing the flowable interrogator from the downhole interrogator storage structure, toward a surface region, and/or within the produced fluid stream, which flows within the tubular conduit. This may include conveying the flowable interrogator within the tubular conduit, entraining the flowable interrogator in and/or within the produced fluid stream, and/or producing the flowable interrogator from the hydrocarbon well in and/or within the produced fluid stream.

The flowing at 215 may be performed with any suitable timing and/or sequence during methods 200. As examples, the flowing at 215 may be performed during the decreasing at 205, subsequent to the releasing at 210, and/or during the interrogating at 220.

Interrogating the radio frequency identification (RFID) tag at 220 may include interrogating each RFID tag in an interrogated subset of the plurality of RFID tags and/or interrogating each RFID tag with the flowable interrogator. The interrogating at 220 may be performed during the flowing at 215 and/or when the flowable interrogator is proximate, or in radio frequency communication with, each RFID tag. Examples of the plurality of RFID tags include at least 5, at least 10, at least 20, at least 40, at least 60, at least 80, and/or at least 100 RFID tags. Examples of the interrogated subset of the plurality of RFID tags include at least 1, at least 2, at least 4, at least 6, at least 8, at least 10, at least 15, and/or at least 20 RFID tags. Additional or alternative examples of the interrogated subset of the plurality of RFID tags include at least 10%, at least 20%, at least 30%, at least 40%, at least 50%, at least 60%, at least 70%, at least 80%, at least 90%, 100%, at most 100%, at most 90%, at most 80%, at most 70%, at most 60%, and/or at most 50% of the plurality of RFID tags.

In some examples, the interrogating at 220 may include transmitting an excitation signal from the flowable interrogator and/or to each RFID tag, as indicated in FIG. 6 at 221. Examples of the excitation signal and/or of structures that may be utilized to transmit the excitation signal are disclosed herein with reference to RFID transmitter 110, excitation signal 112, RF generator 114, and/or RF transmitter antenna 116 of FIGS. 1 and/or 5. In some examples, the interrogating at 220 may include receiving the excitation signal from the flowable interrogator and/or with each RFID tag, as indicated in FIG. 6 at 222.

In some examples, the interrogating at 220 may include generating a corresponding resultant signal with each RFID tag, as indicated in FIG. 6 at 223. The generating at 223 may be responsive, or at least partially responsive, to the receiving at 222. Examples of the resultant signal and/or of structures that may be utilized to generate the resultant signal are disclosed herein with reference to RFID tags 40, RFID tag processor 41, RFID tag memory device 42, RFID tag antenna 43, RFID tag power source 44, and/or resultant signal 46 of FIGS. 1 and 4.

In some examples, the interrogating at 220 may include receiving the corresponding resultant signal with the flowable interrogator, as indicated in FIG. 6 at 224. Examples of structures that may be utilized to receive the corresponding resultant signal are disclosed herein with reference to RFID receiver 120, RF receiver antenna 122, and/or RF signal processor 124 of FIG. 4.

In some examples, the interrogating at 220 may include storing signal data that is representative of the corresponding resultant signal of each RFID tag, as indicated in FIG. 6 at 225. The signal data may correlate the corresponding resultant signal to each RFID tag. The storing at 225 may include storing with, via, and/or utilizing a data storage structure of the flowable interrogator. Examples of the data storage structure are disclosed herein with reference to data storage structure 130 of FIG. 5.

Collecting the flowable interrogator at 230 may include collecting the flowable interrogator with a collection structure of the hydrocarbon well and/or of a well-side communication device of the hydrocarbon well. In some examples, the collecting at 230 may be performed to permit, to facilitate, and/or to improve a signal-to-noise ratio of the receiving at 235. In these examples, the collecting at 230 may be performed prior to the receiving at 235. Examples of the collection structure are disclosed herein with reference to collection structure 69 of FIG. 1. Examples of the well-side communication device are disclosed herein with reference to well-side communication device 60 of FIG. 1.

Receiving the transmitted data stream at 235 may include receiving the transmitted data stream from the flowable interrogator. This may include receiving the transmitted data stream with, via, and/or utilizing the well-side communication device. The transmitted data stream may be indicative of and/or based upon the corresponding resultant signal and/or the signal data. Examples of the transmitted data stream are disclosed herein with reference to transmitted data stream 142 include an acoustic transmitted data stream, an optical transmitted data stream, and/or an electromagnetic transmitted data stream.

In some examples, the well-side communication device may include and/or be a downhole well-side communication device. In these examples, the receiving at 235 may include receiving the transmitted data stream during the flowing at 215 and/or while the flowable interrogator is positioned within the subsurface region. Examples of the downhole well-side communication device are disclosed herein with reference to downhole well-side communication device 62 of FIG. 1.

In some examples, the well-side communication device may include and/or be an uphole well-side communication device. In these examples, the receiving at 235 may include receiving the transmitted data stream during the flowing at 215, subsequent to the flowing at 215, subsequent to the flowable interrogator being produced from the subsurface region, and/or while the flowable interrogator is positioned within the surface region.

Analyzing the transmitted data stream at 240 may include analyzing the transmitted data stream to determine at least one property of the hydrocarbon well. In some examples, the at least one property of the hydrocarbon well may include and/or be indicative of an obstruction within the tubular conduit and/or of at least one property of the obstruction. More specifically, the at least one property of the hydrocarbon well may include and/or be the formation of the obstruction within the tubular conduit and/or a growth characteristic, or growth kinetics, of the obstruction within the tubular conduit. Additional examples of the at least one property of the obstruction include an estimate of a location of the obstruction within the tubular conduit, an indication of formation of the obstruction within the tubular conduit, and/or an estimate of at least one physical property of the obstruction. Examples of the at least one physical property of the obstruction include a size of the obstruction, a composition of the obstruction, a material property of the obstruction, a chemical property of the obstruction, and/or an extent of the obstruction along the length of the tubular conduit.

The analyzing at 240 may be utilized to determine the at least one property of the obstruction in any suitable manner. As an example, the analyzing at 240 may include correlating attenuation of at least one of the excitation signal and the corresponding resultant signal to the at least one property of the obstruction. As another example, the analyzing at 240 may include correlating a phase shift in at least one of the excitation signal and the corresponding resultant signal to the at least one property of the obstruction. As yet another example, the analyzing at 240 may include correlating a signal strength of the corresponding resultant signal, as received by the flowable interrogator, to the at least one property of the obstruction.

In some examples, the corresponding resultant signal of a given RFID tag may indicate formation of the obstruction. In these examples, the analyzing at 240 further may include estimating a location of the obstruction within the tubular conduit based, at least in part, on a location of the given RFID tag along the length of the tubular conduit.

In some examples, at least a subset of the plurality of RFID tags may include a unique identifier that uniquely identifies, or distinguishes, each RFID tag of the subset of the plurality of RFID tags from each other RFID tag of the subset of the plurality of RFID tags. In these examples, the analyzing at 240 further may include associating corresponding signal data with a corresponding RFID tag based, at least in part, on the unique identifier. Stated another way, the analyzing at 240 may include associating the corresponding signal data with the unique identifier of the RFID tag that generated the resultant signal upon which the corresponding signal data is based.

Indicating to the operator at 245 may include making any suitable indication to an operator of the hydrocarbon well in any suitable manner and may be based, at least in part, on the at least one property of the hydrocarbon well and/or on the at least one property of the obstruction. As an example, the indicating at 245 may include indicating that a cleanout operation should be performed within the hydrocarbon well. As another example, the indicating at 245 may include indicating a location at which the cleanout operation should be performed within the hydrocarbon well.

Selecting the downhole operation parameter at 250 may include selecting any suitable parameter for any suitable downhole operation and may be based, at least in part, on the at least one property of the hydrocarbon well and/or on the at least one property of the obstruction. As an example, the selecting at 250 may include selecting at least one parameter of the cleanout operation. Examples of the at least one parameter of the cleanout operation include a type of cleanout operation to be performed, a type of equipment to be utilized during the cleanout operation, and/or a length of an umbilical needed to perform the cleanout operation and/or to reach the obstruction.

Performing the downhole operation at 255 may include performing any suitable downhole operation at least partially responsive to and/or based upon the at least one property of the hydrocarbon well and/or the at least one property of the obstruction. As an example, the performing at 255 may include performing the cleanout operation within the hydrocarbon well.

Repeating at 260 may include repeating any suitable step and/or steps of methods 200 in any suitable order and/or for any suitable purpose. As an example, the flowable interrogator may be a first flowable interrogator, the interrogated subset of the plurality of RFID tags may be a first interrogated subset of the plurality of RFID tags, and the transmitted data stream may be a first transmitted data stream. In this example, the repeating at 260 may include repeating the releasing at 210 to release a second flowable interrogator into the tubular conduit and repeating the flowing at 215 to flow the second flowable interrogator toward the surface region. Also in this example, the repeating at 260 may include repeating the interrogating at 220 to interrogate each RFID tag in a second interrogated subset of the plurality of RFID tags and repeating the receiving at 235 to receive a second transmitted data stream from the second flowable interrogator.

Also in this example, the repeating at 260 further may include repeating the analyzing at 240 to analyze the second transmitted data stream and/or to determine the at least one property of the hydrocarbon well. The repeating the analyzing at 240 also may include comparing the first transmitted data stream to the second transmitted data stream. The comparing may include comparing to determine the at least one property of the hydrocarbon well, such as may be based upon the comparison, and/or to determine a change in the at least one property of the hydrocarbon well, such as may be based upon the comparison.

In some examples, the repeating at 260 may include sequentially releasing a plurality of flowable interrogators from the downhole interrogator storage structure. In these examples, the repeating at 260 further may include repeating the flowing at 215, repeating the interrogating at 220, repeating the receiving at 235, and/or repeating the analyzing at 240 for each flowable interrogator of the plurality of flowable interrogators.

In some examples, and as discussed, an obstruction may be present and/or positioned within the wellbore. In such examples, if the releasing at 210 includes releasing the flowable interrogator from a downhole interrogator storage structure that is downhole from the obstruction, the flowable interrogator may be trapped and/or retained by the obstruction and/or may not flow past the obstruction within the wellbore. This may decrease an amount of information that the downhole interrogator provides regarding the obstruction and/or a location of the obstruction within the wellbore.

In this example, the repeating at 260 may include repeating the releasing at 210 to release another flowable interrogator from another downhole interrogator storage structure that is uphole from the obstruction. Also in this example, the repeating at 260 may include repeating the flowing at 215 with the other flowable interrogator, repeating the interrogating at 220 with the other flowable interrogator, repeating the receiving at 235 to receive another transmitted data stream from the other flowable interrogator, and/or repeating the analyzing at 240 to analyze the other transmitted data stream.

Since the other flowable interrogator is released uphole from the obstruction, the other flowable interrogator may flow within the wellbore and/or toward the surface region. The combination of the information obtained via release of the flowable interrogator from the downhole interrogator storage structure that is downhole from the obstruction and release of the other flowable interrogator from the downhole interrogator storage structure that is uphole from the obstruction may permit and/or facilitate more accurate determination of the location of the obstruction within the wellbore.

As discussed in more detail herein, a subset of the plurality of RFID tags may be positioned within a corresponding predetermined tag region of the downhole tubular. Examples of the subset of the plurality of RFID tags are disclosed herein. In such a configuration, the interrogating at 220 may include interrogating each RFID tag in the subset of the plurality of RFID tags. Also in such a configuration, the analyzing at 240 may include determining a position of the flowable interrogator within a transverse cross-section of the tubular conduit as the flowable interrogator flows through the predetermined tag region and/or determining at least one property of an obstruction that is proximate the predetermined tag region. The determining may be based, at least in part, on the corresponding resultant signal received by the flowable interrogator and/or from each RFID tag in the subset of the plurality of RFID tags and is discussed in more detail herein with reference to FIG. 3.

As also discussed in more detail herein, the flowable interrogator may include a sensor, such as sensor 150 of FIG. 5. The sensor may be configured to detect and/or to determine a sensed parameter. When the flowable interrogator includes the sensor, the transmitted data stream may include information regarding the sensed parameter. Examples of the sensed parameter are disclosed herein.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B")

may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated to disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A hydrocarbon well, comprising:

a wellbore that extends from a surface region and within a subsurface region;

a downhole tubular that defines a tubular conduit and extends within the wellbore;

a plurality of radio frequency identification (RFID) tags spaced-apart along a length of the downhole tubular, wherein each RFID tag of the plurality of RFID tags is operatively attached to the downhole tubular and is positioned within a corresponding predetermined tag region of the downhole tubular;

a downhole interrogator storage structure that includes a plurality of flowable interrogators, wherein the downhole interrogator storage structure is configured to selectively release a given flowable interrogator of the plurality of flowable interrogators responsive to a release criteria, wherein the given flowable interrogator is configured to flow from the downhole interrogator storage structure toward the surface region within a produced fluid stream that is produced from the hydrocarbon well, and further wherein the given flowable interrogator includes:

(i) an RFID transmitter configured to transmit an excitation signal, wherein, responsive to receipt of the excitation signal, each RFID tag is configured to generate a corresponding resultant signal;

(ii) an RFID receiver configured to receive the corresponding resultant signal;

(iii) a data storage structure configured to store signal data that is representative of the corresponding resultant signal; and (iv) an interrogator-side communication device configured to transmit a transmitted data stream that is indicative of the signal data; and a well-side communication device configured to receive the transmitted data stream from the interrogator-side communication device of the flowable interrogator;

wherein the hydrocarbon well further includes a signal processing assembly programmed to process the signal data;

wherein the downhole interrogator storage structure is configured to sequentially release a plurality of released flowable interrogators, wherein the well-side communication device is configured to receive a corresponding transmitted data stream from each flowable interrogator of the plurality of flowable interrogators, and further wherein the signal processing assembly is programmed to determine at least one property of the hydrocarbon well based, at least in part, on a change in the corresponding transmitted data stream between sequentially released flowable interrogators of the plurality of released flowable interrogators.

2. The hydrocarbon well of claim 1, wherein a subset of the plurality of RFID tags is positioned within each corresponding predetermined tag region of the downhole tubular.

3. The hydrocarbon well of claim 1, wherein at least a subset of the plurality of RFID tags includes a unique identifier that uniquely distinguishes each RFID tag of the subset of the plurality of RFID tags from each other RFID tag of the subset of the plurality of RFID tags, and further wherein the corresponding resultant signal of the subset of the plurality of RFID tags includes the unique identifier.

4. The hydrocarbon well of claim 3, wherein the unique identifier is associated with the corresponding predetermined tag region of the subset of the plurality of RFID tags.

5. The hydrocarbon well of claim 1, wherein the flowable interrogator further includes a sensor.

6. The hydrocarbon well of claim 5, wherein the sensor includes at least one of:

(i) a magnetometer configured to determine at least one property of a magnetic field within the wellbore, wherein the transmitted data stream includes information regarding the at least one property of the magnetic field within the wellbore;

(ii) a coupling locator configured to detect motion of the flowable interrogator past tubing couplers of the downhole tubular, wherein the transmitted data stream includes information regarding motion of the flowable interrogator past the tubing couplers of the downhole tubular;

(iii) an ultrasonic sensor configured to detect an ultrasonic signature within the wellbore, wherein the transmitted data stream includes information regarding the ultrasonic signature within the wellbore;

(iv) an imaging device configured to detect at least one image of the wellbore, wherein the transmitted data stream includes information regarding the at least one image of the wellbore;

(v) a temperature sensor configured to detect a downhole temperature within the wellbore, wherein the transmitted data stream includes information regarding the downhole temperature within the wellbore;

(vi) a pressure sensor configured to detect a downhole pressure within the wellbore, wherein the transmitted data stream includes information regarding the downhole pressure within the wellbore;

(vii) a pH sensor configured to detect a pH within the wellbore, wherein the transmitted data stream includes information regarding the pH within the wellbore;

(viii) a vibration sensor configured to detect vibration within the wellbore, wherein the transmitted data stream includes information regarding the vibration within the wellbore;

(ix) an accelerometer configured to detect acceleration of the flowable interrogator within the wellbore, wherein the transmitted data stream includes information regarding the acceleration of the flowable interrogator within the wellbore; and (x) a velocimeter configured to detect a velocity of the flowable interrogator within the wellbore, wherein the transmitted data stream includes information regarding the velocity of the flowable interrogator within the wellbore.

7. The hydrocarbon well of claim 1, wherein the data storage structure is configured to associate the signal data with a corresponding RFID tag that generated the corresponding resultant signal.

8. The hydrocarbon well of claim 1, wherein the well-side communication device includes a downhole well-side communication device configured to receive the transmitted data stream while the flowable interrogator is positioned within the subsurface region.

9. The hydrocarbon well of claim 1, wherein the well-side communication device includes an uphole well-side communication device configured to receive the transmitted data stream subsequent to the flowable interrogator being produced from the subsurface region.

10. The hydrocarbon well of claim 1, wherein the well-side communication device includes a collection structure configured to separate the flowable interrogator from the produced fluid stream.

11. The hydrocarbon well of claim 1, wherein the signal processing assembly is programmed to at least one of:

(i) estimate a location of an obstruction within the tubular conduit based, at least in part, on the signal data;

(ii) indicate formation of the obstruction within the tubular conduit based, at least in part, on the signal data; and (iii) estimate at least one physical property of the obstruction within the tubular conduit based, at least in part, on the signal data.

12. The hydrocarbon well of claim 1, wherein the signal processing assembly is programmed to at least one of:

(i) indicate, to an operator of the hydrocarbon well, that a cleanout operation should be performed on the hydrocarbon well; and (ii) indicate, to the operator of the hydrocarbon well, a location at which the cleanout operation should be performed within the hydrocarbon well.

13. The hydrocarbon well of claim 1, wherein the at least one property of the hydrocarbon well includes at least one of:

(i) formation of an obstruction within the tubular conduit; and (ii) a growth characteristic of the obstruction within the tubular conduit.

* * * * *